US007865121B2

(12) United States Patent
Iwasaki et al.

(10) Patent No.: US 7,865,121 B2
(45) Date of Patent: Jan. 4, 2011

(54) IMAGE FORMING APPARATUS AND RECORDING MEDIUM

(75) Inventors: Yukiko Iwasaki, Yokohama (JP); Kazuhisa Sudo, Kawasaki (JP); Reki Nakamura, Sagamihara (JP); Mikio Ishibashi, Yokohama (JP); Nobuyuki Koinuma, Yokohama (JP); Toshihiro Sugiyama, Tokyo (JP); Takashi Sakamaki, Ebina (JP); Megumi Ohtoshi, Kawasaki (JP); Masafumi Yamada, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 11/774,678

(22) Filed: Jul. 9, 2007

(65) Prior Publication Data

US 2008/0008946 A1 Jan. 10, 2008

(30) Foreign Application Priority Data

Jul. 7, 2006 (JP) ..... 2006-188661
Jun. 1, 2007 (JP) ..... 2007-147328

(51) Int. Cl.
*G03G 15/20* (2006.01)

(52) U.S. Cl. ..... 399/341; 399/342

(58) Field of Classification Search ..... 399/341–342
See application file for complete search history.

(56) References Cited

U.S. PATENT DOCUMENTS 5,392,104 A * 2/1995 Johnson ..... 399/301
2004/0053157 A1* 3/2004 Yoshinari ..... 430/203
2005/0214669 A1 9/2005 Hayashi et al.
2007/0059027 A1* 3/2007 Ishikawa et al. ..... 399/101

FOREIGN PATENT DOCUMENTS

| | | |
|---|---|---|
| CN | 1166624 A | 12/1997 |
| CN | 1673879 A | 9/2005 |
| JP | 11-2915 | 1/1999 |
| JP | 2002-341623 | 11/2002 |
| JP | 2003-270991 | 9/2003 |
| JP | 2004-191678 | 7/2004 |
| JP | 2005-134559 | 5/2005 |
| JP | 2005-178294 | 7/2005 |

OTHER PUBLICATIONS

U.S. Appl. No. 11/958,054, filed Dec. 17, 2007, Sudo, et al.

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

An image forming apparatus that includes an image bearing member to bear a latent electrostatic image, a charging device to charge a surface of the image bearing member, an irradiating device to irradiate the surface of the image bearing member to form the latent electrostatic image thereon, a developing device to develop the latent electrostatic image, an optional cleaning unit to clean the surface of the image bearing member, a transfer device to transfer the developed image to an opaque medium, an optional cleaning device to clean a surface of the transfer device, a fixing device to fix the transferred image on the opaque medium, and an attachment device to attach the fixed image to a transparent medium after the opaque medium is overlaid with the transparent medium, and recording media for use in the image forming apparatus.

9 Claims, 6 Drawing Sheets

IMAGE FORMING APPARATUS AND RECORDING MEDIUM

This patent specification is based on Japanese patent applications, Nos. 2006-188661 filed on Jul. 7, 2006 and 2007-147328 filed on Jun. 1, 2007 in the Japan Patent Office, the entire contents of which are incorporated by reference herein.

BACKGROUND OF THE INVENTION

1. Field of the Invention

The present invention relates to an image forming apparatus and a recording medium, and more particularly, to an image forming apparatus capable of forming a photographic image and having a simple structure and a recording medium for use in the image forming apparatus.

2. Discussion of the Background

There have been various attempts to form a glossy photographic image using an image forming apparatus that employs an electrophotographic process.

One typical method is to use a transparent toner to produce a glossy image. A transparent toner is uniformly applied to and fixed on the entire surface of a sheet between image formation and fixing to obtain a photographic image. However, this method has drawbacks such that the transparent toner is continuously and uniformly supplied, and the fixing unit is subject to heavy load due to a difference in toner layer thickness between an image part and a non-image part.

Another typical method is to use a recording medium that has a thermoplastic resin layer. After fixing an image on a recording medium, additional pressure and heat are applied thereto to obtain a glossy image. However, this technology achieves a desired effect in combination with a particular fixing device, which causes problems on configuration, costs, power consumption, etc.

Still another typical method is to use two fixing devices to produce a glossy image. After the normal fixing of a toner image, another fixing device having a belt with high surface smoothness remelts the toner, and cools and peels the recording medium. In this method, a belt having a smooth surface is desired, which leads to restructuring, cost increase, etc. However, the configuration and cost for producing the belt with high surface smoothness need to be improved.

FIG. 1 schematically illustrates a structure of a typical photographic image. In the typical methods, the surface smoothness of a toner layer formed on a recording medium is improved to print a high quality photographic image, which is viewed from the side of the image.

When the toner layer surface, from which an image is viewed, is smooth, the toner image is recognized as a photographic image since light reflected therefrom is perceived as glossy. However, a fixing belt with a smooth surface to make the toner layer surface smooth is desired, which leads to increase in cost.

SUMMARY OF THE INVENTION

In one embodiment of the present invention an image forming apparatus is provided that overcomes the above noted disadvantages, while providing a high quality photographic image and having a simple structure.

In a further embodiment of the present invention, a recording medium is provided for use in the image forming apparatus, wherein the recording medium includes an opaque medium having an image carrier surface and a transparent medium having a toner carrier surface, wherein an average surface roughness R1 of the image carrier surface and an average surface roughness R2 of the toner carrier surface has the following relationship: R1<R2.

In another embodiment of the present invention, a recording medium is provided for use in the image forming apparatus, wherein the recording medium includes an opaque medium having an image carrier surface and a transparent medium having a toner carrier surface, wherein a contact angle A1 formed between water and the image carrier surface and a contact angle A2 formed between water and the toner carrier surface has the following relationship: A1>A2.

These and other embodiments of the present invention, either individually or in combinations, are provided by the discovery of an image forming apparatus, comprising an image bearing member to bear a latent electrostatic image, a charging device to charge a surface of the image bearing member, an irradiating device to irradiate the surface of the image bearing member to form the latent electrostatic image thereon, a developing device to develop the latent electrostatic image, an optional cleaning unit to clean the surface of the image bearing member, a transfer device to transfer the developed image to an opaque medium, an optional cleaning device to clean a surface of the transfer device, a fixing device to fix the transferred image on the opaque medium, and an attachment device to attach the fixed image to a transparent medium after the opaque medium is overlaid with the transparent medium, and recording media for use with the image forming apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
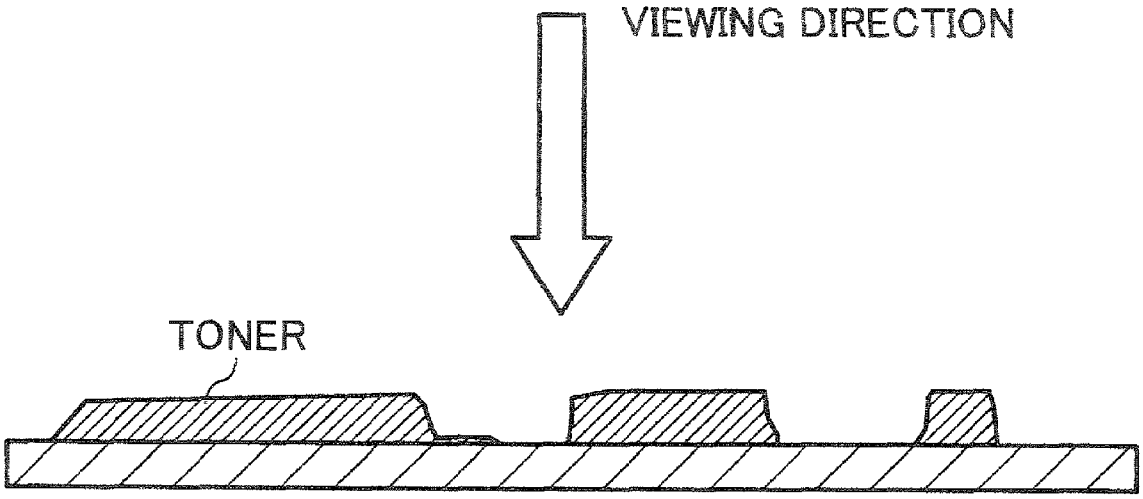
FIG. 1 BACKGROUND ART
FIG. 1 schematically illustrates a structure of a typical photographic image.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, a post-processing device included in an image forming apparatus according to an exemplary embodiment of the present invention is described.

Figure 2:
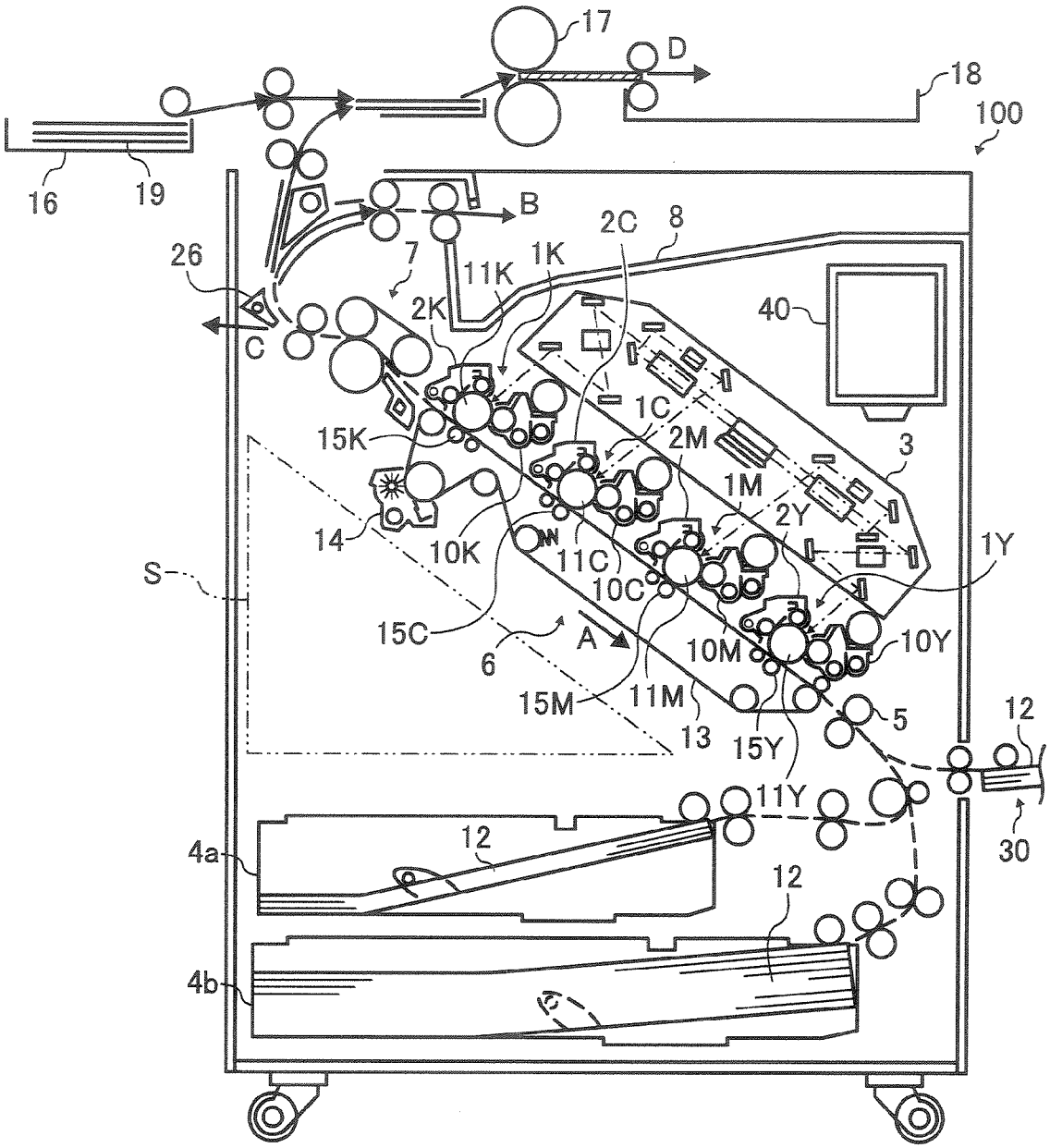
FIG. 2 schematically illustrates an image forming apparatus according to an exemplary embodiment of the present invention.

FIG. 2 schematically illustrates an image forming apparatus 100 according to an exemplary embodiment of the present invention. The image forming apparatus 100 employs an electrophotographic process and includes four image forming units 1Y, 1M, 1C, and 1K. The four image forming units 1Y, 1M, 1C, and 1K form toner images (which is also referred to as image hereinafter) of four colors: yellow, magenta, cyan, and black, which are abbreviated as Y, M, C, and K, respectively. The abbreviations are omitted as necessary. The color order is not limited to the order of Y, M, C, and K as illustrated in FIG. 2. Namely, the image forming units 1Y, 1M, 1C, and 1K can be provided in a different order.

The image forming units 1Y, 1M, 1C, and 1K include photoconductive units 2Y, 2M, 2C, and 2K, respectively. The image forming units 1Y, 1M, 1C, and 1K also include development devices 10Y, 10M, 10C, and 10K, respectively. The photoconductive units 2Y, 2M, 2C, and 2K include photoconductive drums 11Y, 11M, 11C, and 11K, respectively that serve as an image carrier. Each of the photoconductive units 2Y, 2M, 2C, and 2K also includes a charge roller and a cleaning unit.

The image forming units 1Y, 1M, 1C, and 1K are provided in such a manner that rotation axes of the photoconductive drums 11Y, 11M, 11C, and 11K are arranged in parallel with one another with a predetermined pitch therebetween relative to the moving direction of a transfer sheet 12.

An optical writing unit 3 is provided above the image forming units 1Y, 1M, 1C, and 1K. The optical writing unit 3 includes an optical source, a polygon mirror, an fθ lens, a reflection mirror, etc. The optical writing unit 3 scans and irradiates surfaces of the photoconductive drums 11Y, 11M, 11C, and 11K with a laser beam based on image data.

A transfer unit 6 is provided below the image forming units 1Y, 1M, 1C, and 1K. The transfer unit 6 serves as a belt drive device and includes a transfer conveyance belt 13. The transfer conveyance belt 13 holds and conveys the transfer sheet 12 while revolving in the direction indicated by an arrow A shown in FIG. 2 so that the transfer sheet 12 passes through transfer parts of the respective image forming units 1Y, 1M, 1C, and 1K.

A cleaning device 14 is arranged in contact with the outer surface of the transfer conveyance belt 13. The cleaning device 14 includes a brush roller and a cleaning blade. The cleaning device 14 removes foreign substances, for example, a toner adhered to the transfer conveyance belt 13.

A fixing unit 7, a discharge tray 8, etc. are provided above the transfer unit 6. The fixing unit 7 employs a belt fixing system. Paper cassettes 4*a* and 4*b* that store the transfer sheet 12 are provided at a lower portion of the image forming apparatus 100. A manual feeding tray 30 is provided to manually feed the transfer sheet 12 from a side of the image forming apparatus 100.

In addition, the image forming apparatus 100 includes a toner supply container 40. There are provided a waste toner bottle (not shown), a double-side reversing unit (not shown), a power unit (not shown), etc. in a space S enclosed by a long dashed double-short dashed line in FIG. 2.

The development devices 10Y, 10M, 10C, and 10K serving as a development unit have the same configuration, and employ the same two-component developer system with a different color of toner. The developer stored in each of the development devices 10Y, 10M, 10C, and 10K includes a toner and a magnetic carrier.

The development device 10 includes a development roller, a screw, a toner density sensor, etc. The development roller faces the photoconductive drum 11 and includes a rotatable sleeve and a magnet fixed therein. The screw conveys and agitates the developer. A toner replenishing device replenishes a toner according to the output of the toner density sensor.

Next, the image formation process is described. A power supply (not shown) applies a voltage to the charge roller to charge the surface of the photoconductive drum 11 (for example, the photoconductive drum 11K) facing the charge roller. On the surface of the charged photoconductive drum 11, the optical writing unit 3 scans a laser beam based on image data and writes a latent electrostatic image. When the latent electrostatic image held on the surface of the photoconductive drum 11 reaches the development device 10 (for example, the development device 10K), a toner is supplied to the latent electrostatic image on the photoconductive drum 11 by the development roller provided facing the photoconductive drum 11 to form a toner image.

The same process is applied to each of the photoconductive units 2Y, 2M, 2C, and 2K so that color toner images are formed on the surfaces of the photoconductive drums 11Y, 11M, 11C, and 11K.

The transfer sheet 12 (an opaque medium for a photographic image) is fed from one of the paper cassettes 4*a* and 4*b* and the manual feeding tray 30 to registration rollers 5, where the transfer sheet 12 is temporarily stopped.

After the transfer sheet 12 is released from the registration rollers 5, the toner images formed on the respective photoconductive drums 11Y, 11M, 11C, and 11K are sequentially transferred onto the transfer sheet 12, while the transfer sheet 12 is conveyed on the transfer conveyance belt 13.

The toner images are transferred by applying a voltage having a reverse polarity to that of the toner image to the photoconductive drums 11Y, 11M, 11C, and 11K by a power supply (not shown) using primary transfer rollers 15Y, 15M, 15C, and 15K. The primary transfer rollers 15Y, 15M, 15C, and 15K are provided facing the photoconductive drums 11Y, 11M, 11C, and 11K, respectively, with the transfer conveyance belt 13 therebetween.

When the transfer sheet 12 passes through the photoconductive drum 11K and the primary transfer roller 15K, the four toner images are overlapped on the transfer sheet 12. The transfer sheet 12 is conveyed to the fixing unit 7 and the toner image is fixed upon application of heat and pressure.

After fixing, there are two sheet paths for the transfer sheet 12. One is for a photographic image and the other for a non-photographic image. The transfer sheet 12 for having a non-photographic image thereon is discharged to the discharge tray 8 along the direction indicated by an arrow B, or to the direction indicated by an arrow C shown in FIG. 2.

In contrast, the transfer sheet 12 for having a photographic image thereon is directed to a discharge tray 18 in the direction indicated by an arrow D shown in FIG. 2 by way of a heating device 17 after a switching member 26. On its way to the discharge tray 18, the transfer sheet 12 is overlaid with a transparent medium 19, which is fed from a transparent medium tray 16. The transparent medium tray 16 is located higher than the discharge tray 8.

Figure 3:
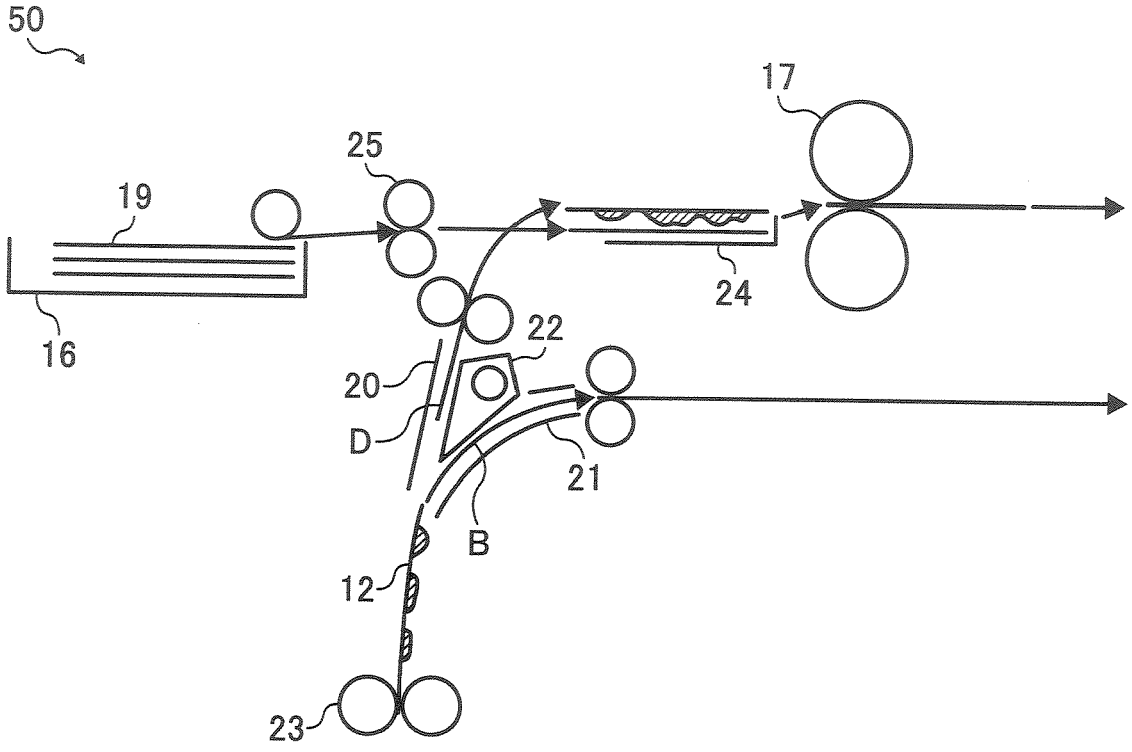
FIG. 3 schematically illustrates a post-processing device included in the image forming apparatus of FIG. 2.
Figure 4A:
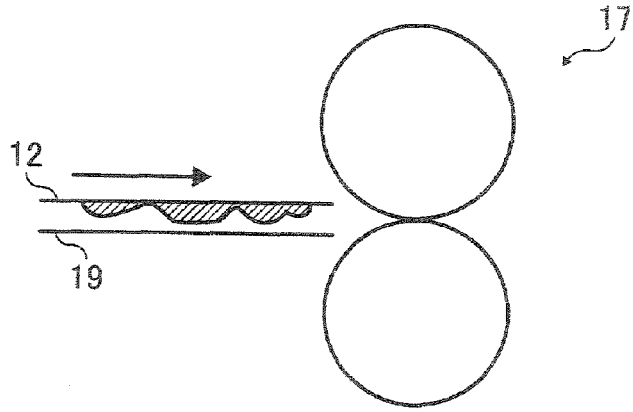
FIGS. 4A to 4C schematically illustrate behavior of a toner image sandwiched between an opaque medium and a transparent medium in relation to a heating device included in the post-processing device of FIG. 3.
Figure 4B:
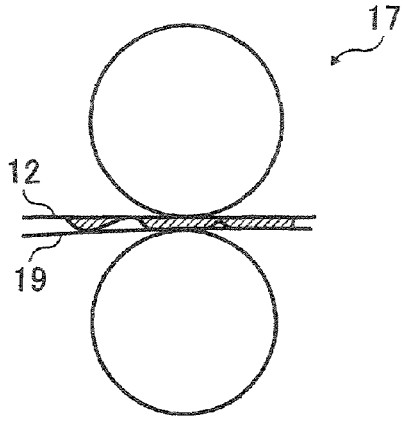
Figure 4C:
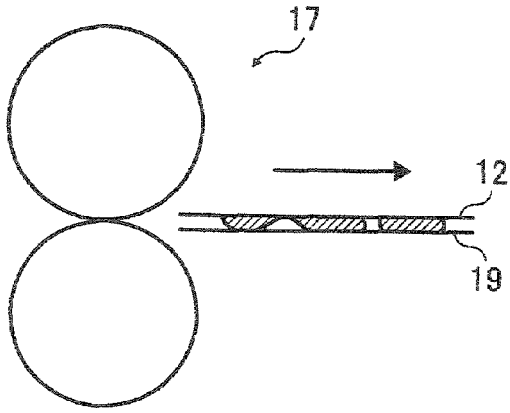
Figure 5A:
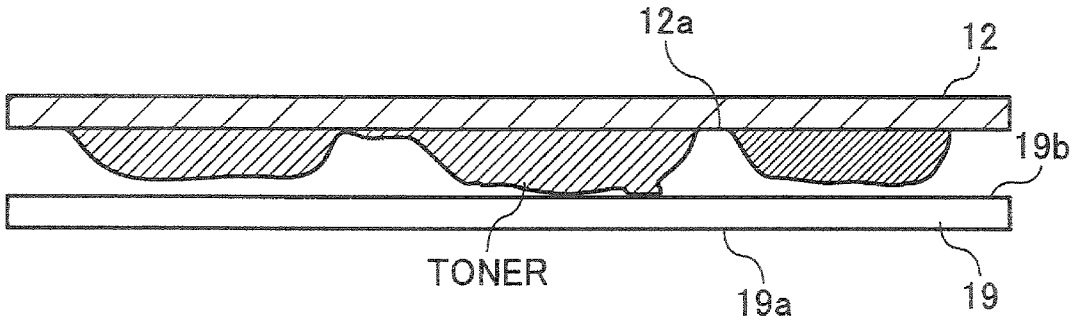
FIGS. 5A and 5B schematically illustrate the behavior of the toner image between the opaque medium and the transparent medium before and after passing through the heating device.
Figure 5B:
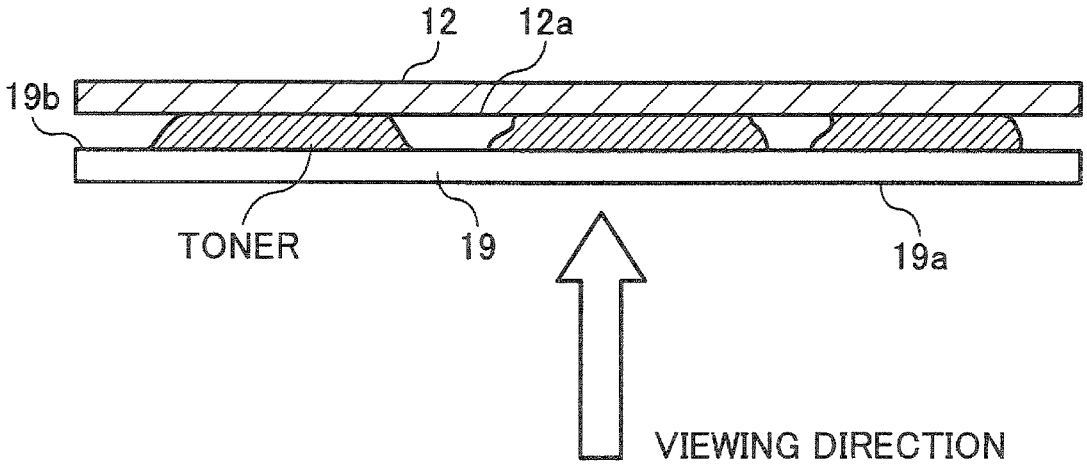

FIG. 3 schematically illustrates a post-processing device 50 and behavior of the transfer sheet 12 and the transparent medium 19. The post-processing device 50 overlays the transfer sheet 12 (which is referred to as opaque medium 12 hereinafter) having the toner image thereon with the transparent medium 19 and attaches the toner image to the transparent medium 19 to form a photographic image. FIGS. 4A to 4C schematically illustrate the behavior of the toner image sandwiched between the opaque medium 12 and the transparent medium 19 in relation to the heating device 17. FIGS. 5A and 5B schematically illustrate the behavior of the toner image between the opaque medium 12 and the transparent medium 19 before and after passing through the heating device 17.

The opaque medium 12 is discharged by discharge rollers 23 and directed by a sheet path switching member 22 provided in the middle of the sheet path to the path indicated by the arrow B leading to the discharge tray 8 or to the path indicated by the arrow D leading to the discharge tray 18. Conveyance guide plates 21 and 22 are provided to guide the opaque medium 12 to the respective directions.

To obtain a photographic image, the opaque medium 12 is sent in the D direction shown in FIG. 3. The opaque medium 12 is overlaid with the transparent medium 19 provided in time with the opaque medium 12 at a stopper 24. The overlaid medium, i.e. the opaque medium 12 and the transparent medium 19, is output to the discharge tray 18 through the heating device 17. Thus, the opaque medium 12 and the transparent medium 19 form a recording medium for obtaining a photographic image.

Figure 6:
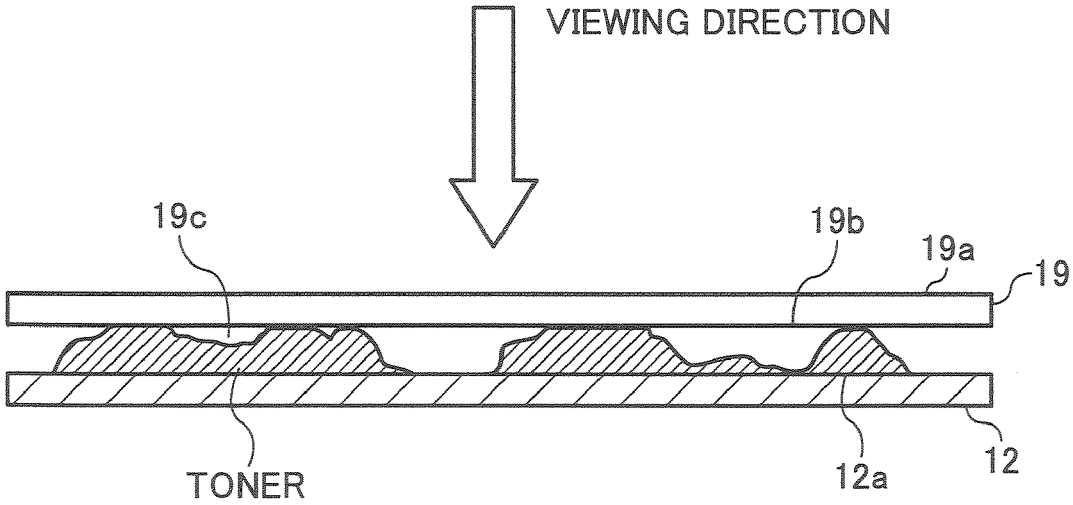
FIG. 6 schematically illustrates a comparative example of a photographic image against the exemplary embodiment of the present invention.

As illustrated in FIG. 5A, the toner is attached to the opaque medium 12 and slightly attached to the transparent medium 19 before the opaque medium 12 and the transparent medium 19 are heated by the heating device 17. This is illustrated in FIG. 6 with a viewing direction.

Upon application of heat and pressure by the heating device 17, the toner is remelted and attached to the transparent medium 19 as well as to the opaque medium 12.

Namely, by applying heat and pressure to the transparent medium 19 and the opaque medium 12 which are overlaid with each other with the toner image therebetween to melt the toner, the toner image is also attached to the transparent medium 19 and results in a photographic image. In this case, the photographic image is viewed from a viewing surface 19*a*, which is opposite to a toner carrier surface 19*b*.

It is preferable to overlay the opaque medium 12 from above with the transparent medium 19 to improve an attachment property between the heated and melted toner and the transparent medium 19, as illustrated in FIGS. 3 to 5B.

The quality of a photographic image obtained according to the exemplary embodiment of the present invention greatly depends on smoothness of the viewing surface 19*a*. Therefore, scratches and contamination on the transparent medium 19, which have an adverse impact on the surface smoothness, are undesirable.

In the system embodiment in which a toner image formed and fixed on the opaque medium 12 is attached to the transparent medium 19 after the opaque medium 12 is overlaid with the transparent medium 19, the transparent medium 19 preferably only passes through a short distance from feed rollers 25, the stopper 24, and the heating device 17 to the discharge tray 18.

In this case, the transparent medium 19 does not pass through the image forming process, meaning, images are not formed on the transparent medium 19. Therefore, the transparent medium 19 is hardly contaminated with toner. In addition, since the sheet path is preferably short, the transparent medium 19 is almost free from roller marks or scratches caused by a guide plate. Therefore, a good photographic image is obtained.

Figure 7:
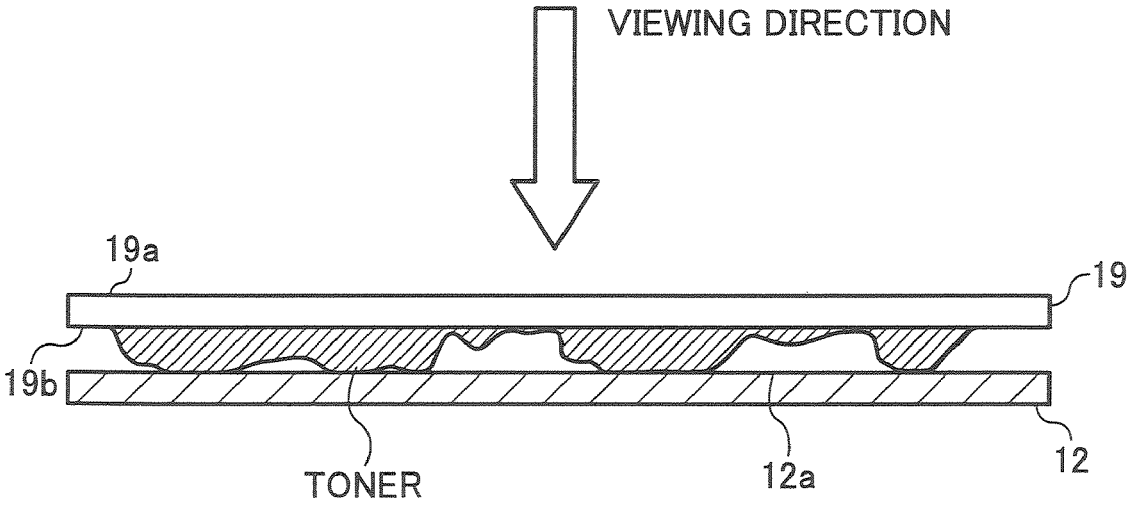
FIG. 7 schematically illustrates a photographic image according to the exemplary embodiment of the present invention.

FIG. 6 schematically illustrates a comparative example of a photographic image against the exemplary embodiment of the present invention. FIG. 7 schematically illustrates a photographic image according to the exemplary embodiment of the present invention. Unlike typical image formation, the photographic image is viewed through the transparent medium 19 in the present invention. In other words, the toner image is viewed from the viewing surface 19*a*, which is opposite to the toner carrier surface 19*b*, as illustrated in FIG. 7.

The quality of a photographic image greatly depends on the smoothness of the viewing surface 19*a* and the attachment property between the toner and the toner carrier surface 19*b*. When the viewing surface 19*a* is smooth, light reflected from the viewing surface 19*a* is perceived as glossy.

In addition, a photographic image having a good attachment property between a toner image and the transparent medium 19 as illustrated in FIG. 7 is recognized as smooth in comparison with a photographic image with a bad attachment property as illustrated in FIG. 6. This is considered to be because a space 19*c* shown in FIG. 6 reflects light.

The present invention provides the image forming apparatus 100 that forms a photographic image by attaching the toner image placed between the transparent medium 19 and the opaque medium 12 to the transparent medium 19 as illustrated in FIG. 7.

To improve the attachment property between toner and the transparent medium 19, it is preferable that the toner tends to be attached to the transparent medium 19 in comparison with the opaque medium 12 to reduce space between the toner and the toner carrier surface 19*b* when the toner is melted.

In other words, it is preferable that the melted toner has a relatively good releasing property to the image carrier surface 12*a* in comparison with the toner carrier surface 19*b*. Since toner has a good releasing property to a material having a low surface roughness, it is preferable that the surface roughness R1 of the image carrier surface 12*a* and the surface roughness R2 of the toner carrier surface 19*b* satisfy the following relationship: R1<R2.

When the surface roughness of the toner carrier surface 19*b* is excessively high, a space is easily formed between the toner layer and the transparent medium 19 when heat and pressure are applied by the heating device 17. Therefore, it is preferable that the surface roughness of the transparent medium 19 is small compared to a thickness of the toner layer.

That is, the more the toner is attached to the transparent medium 19 in comparison with the opaque medium 12 when melted between the transparent medium 19 and the opaque medium 12, the more beautiful the image looks when the image is viewed from the viewing surface 19*a*. Therefore, it is preferable that the toner is attached to the transparent medium 19.

The 10 point average surface roughness Rz according to JIS B0601-1994 is used as the surface roughness. 15 or 20 point average surface roughness can be also used. In light of accuracy, it is good to measure at least around 10 points.

When the 10 point average surface roughness $Rz_{12}$ of the image carrier surface 12*a* and the 10 point average surface roughness $Rz_{19}$ of the toner carrier surface 19*b* satisfy the following relationship: $Rz_{12}<Rz_{19}$, melted toner has a relatively good releasing property to the opaque medium 12 in comparison with the transparent medium 19 and tends to be attached to the transparent medium 19. Consequently, the image looks photographic when the image is viewed from the viewing surface 19*a*.

The repellency or releasing property of melted toner can be determined by contact angle. A material that forms a large contact angle with water or oil tends to repel liquid.

Therefore, it is preferable that the contact angle A1 formed between water and the image carrier surface 12*a* and the contact angle A2 formed between water and the toner carrier surface 19*b* satisfy the following relationship: A1>A2. The image carrier surface 12*a* may be processed to increase the contact angle formed between water and the image carrier surface 12*a*.

In other words, when the contact angle A1 formed between water and the image carrier surface 12*a* and the contact angle A2 formed between water and the toner carrier surface 19*b* satisfy the following relationship: A1>A2, the melted toner tends to be attached to the transparent medium 19, resulting in a beautiful image when viewed from the viewing surface 19*a*.

When the contact angles A1 and A2 satisfy the relationship, the toner has a good releasing property to the opaque medium 12. Therefore, the toner melted on the opaque medium 12 is easily attached to the transparent medium 19. The image thus obtained looks photographic when viewed from the viewing surface 19*a*.

Photographic images are formed using a color laser printer (IPSiO CX8800, manufactured by Ricoh Co., Ltd.), an opaque medium (Color Laser Card, designed for point of purchase display and manufactured by Mitsubishi Kagaku Media Co., Ltd.), and a transparent film (PP2500, manufactured by Sumitomo 3M Ltd.) and the result is good. The 10 point average surface roughness Rz of the Color Laser Card is 1 μm and the contact angle formed between water and the surface thereof is 90 degrees. The 10 point average surface roughness Rz of the transparent film is 3 μm and the contact angle formed between water and the surface thereof is 40 degrees.

When full color plain paper (paper type 6000<70W>, manufactured by Ricoh Co., Ltd.) is used as the opaque medium, a good photographic image is not obtained. The 10 point average surface roughness Rz of the full color plain paper is 11 μm and the contact angle formed between water and the surface thereof is 30 degrees.

The toner which has been attached to the opaque medium 12 is melted and attached to the transparent medium 19 as illustrated in FIGS. 4A to 5B. To melt the toner, a large amount of heat is consumed to heat the transparent medium 19 and the opaque medium 12. To attach the toner to the transparent medium 19, at least the toner on the side of the transparent medium 19 is completely melted.

Therefore, it is preferable that the amount of heat H1 provided to the opaque medium 12 and the amount of heat H2 provided to the transparent medium 19 by the heating device 17 satisfy the following relationship: H1<H2 to easily and efficiently melt the toner layer surface facing the transparent medium 19. The toner image is attached to the transparent medium 19 upon application of pressure.

In addition, since the opaque medium 12 is already heated in the fixing unit 7 as illustrated in FIG. 2, it is preferred to preliminarily heat the transparent medium 19 in the transparent medium tray 16.

The configuration of the image forming apparatus 100 according to the exemplary embodiment is not limited to those described above. For example, a laser emitting diode (LED) may be used to write a latent electrostatic image instead of a laser beam. The development device 10 may employ a one-component developer system instead of the two-component developer system. In the fixing unit 7, a roller may be used instead of the belt, or an induction heating system may be used.

As described above, a photographic image illustrated in FIG. 7 is formed and output through the processes of: forming and primarily fixing a toner image on an opaque medium 12; feeding a transparent medium 19; overlaying the opaque medium 12 with the transparent medium 19; and applying heat and pressure to the opaque medium 12 and the transparent medium 19 to attach the toner image to the transparent medium 19. The viewing surface 19*a* of the transparent medium 19 is not contaminated with toner scattering in the image forming apparatus 100 while being conveyed therein.

Numerous additional modifications and variations are possible in light of the above teachings. It is therefore to be understood that within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable medium and is adapted to perform any one of the aforementioned methods when run on a computer device (a device including a processor). The program may include computer executable instructions for carrying out one or more of the steps above, and/or one or more of the aspects of the invention. Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetic storage media, including but not limited to Floppy Disks™, cassette tapes, and removable hard disks; media with a built-in rewriteable non-volatile memory, including but not limited to memory cards; and media with a built-in ROM, including but not limited to ROM cassettes, etc. Furthermore, various information regarding stored images, for example, property information, may be stored in any other form, or provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

an image bearing member configured to bear a latent electrostatic image;

a charging device configured to charge a surface of the image bearing member;

an irradiating device configured to irradiate the surface of the image bearing member to form the latent electrostatic image thereon;

a developing device configured to develop the latent electrostatic image;

a transfer device configured to transfer the developed image to an opaque medium;

a fixing device configured to fix the transferred image on the opaque medium; and an attachment device comprising a heating device configured to attach the fixed image to a transparent medium; wherein the attachment device is located at a downstream side of the fixing device relative to a feeding direction of the medium, such that the opaque medium bearing the fixed image is overlaid with the transparent medium, followed by additionally fixing and attaching of the fixed image on the transparent medium by the attachment device.

2. The image forming apparatus according to claim 1, wherein an amount of heat H1 provided from a side of the opaque medium and an amount of heat H2 provided from a side of the transparent medium by the heating device has the following relationship:

$$H1<H2.$$

3. The image forming apparatus according to claim 2, wherein the opaque medium comprises an image carrying surface, the transparent medium comprises a toner carrying surface, and an average surface roughness R1 of the image carrying surface and an average surface roughness R2 of the toner carrying surface has the following relationship:

$$R1<R2.$$

4. The image forming apparatus according to claim 2, wherein the opaque medium comprises an image carrying surface, the transparent medium comprises a toner carrying surface, and a contact angle A1 formed between water and the image carrying surface and a contact angle A2 formed between water and the toner carrying surface has the following relationship:

$$A1>A2.$$

5. A recording medium comprising:

an opaque medium comprising an image carrying surface; and a transparent medium comprising a toner carrying surface, wherein an average surface roughness R1 of the image carrying surface and an average surface roughness R2 of the toner carrying surface has the following relationship:

$$R1<R2$$

and wherein the recording medium is used in the image forming apparatus according to claim 1.

6. The recording medium according to claim 5, wherein the average surface roughness R1 and R2 is measured based on 10-point average surface roughness.

7. A recording medium comprising:

an opaque medium comprising an image carrying surface; and a transparent medium comprising a toner carrying surface, wherein a contact angle A1 formed between water and the image carrying surface and a contact angle A2 formed between water and the toner carrying surface has the following relationship:

$$A1>A2.$$

and wherein the recording medium is used in the image forming apparatus according to claim 1.

8. The image forming apparatus according to claim 1, wherein the apparatus further comprises a cleaning unit configured to clean the surface of the image bearing member.

9. The image forming apparatus according to claim 1, wherein the apparatus further comprises a cleaning device configured to clean a surface of the transfer device.

* * * * *